US011118434B2

(12) United States Patent
Hazelip et al.

(10) Patent No.: US 11,118,434 B2
(45) Date of Patent: Sep. 14, 2021

(54) EXPANDABLE HANGER WITH ANCHOR FEATURE

(71) Applicant: Halliburton Energy Services, Inc., Houston, TX (US)

(72) Inventors: Gary Lynn Hazelip, Frisco, TX (US); Emile Edmund Sevadjian, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 69 days.

(21) Appl. No.: 16/505,030

(22) Filed: Jul. 8, 2019

(65) Prior Publication Data

US 2021/0010353 A1 Jan. 14, 2021

(51) Int. Cl.
*E21B 43/10* (2006.01)
*E21B 23/01* (2006.01)

(52) U.S. Cl.
CPC ..... *E21B 43/108* (2013.01); *E21B 23/01* (2013.01)

(58) Field of Classification Search
CPC ..... E21B 23/01; E21B 23/06; E21B 33/128; E21B 33/129; E21B 33/1291; E21B 43/103; E21B 43/105; E21B 43/108; E21B 43/106
See application file for complete search history.

(56) References Cited

U.S. PATENT DOCUMENTS 4,832,129 A 5/1989 Sproul et al.
7,779,906 B2 8/2010 Porter et al.
9,938,787 B2 4/2018 Zakharia et al.
2005/0011650 A1* 1/2005 Harrall ..... E21B 43/105 166/380
2006/0162921 A1 7/2006 Carmody et al.
2007/0039161 A1 2/2007 Garcia
2009/0200041 A1* 8/2009 Watson ..... E21B 43/105 166/382
2014/0018696 A1 1/2014 DeArmond
(Continued)

OTHER PUBLICATIONS

International Search Report and Written Opinion for Application No. PCT/US2019/040853, dated Apr. 6, 2020.
Halliburton, CPS Catalog, 08 Packers Brochure.

*Primary Examiner* — Robert E Fuller
*Assistant Examiner* — Lamia Quaim
(74) *Attorney, Agent, or Firm* — Scott Richardson; C. Tumey Law Group PLLC

(57) ABSTRACT

The present disclosure relates generally to equipment utilized and operations performed in conjunction with a subterranean well and, more particularly, to an improved liner hanger system. A downhole expandable liner hanger positionable in a subterranean wellbore may comprise an expansion element. The expansion element may comprise a tubular body. The expansion element may comprise one or more annular seals bonded to the tubular body. The expansion element may comprise a first spike extending from the tubular body. The expansion element may comprise a second spike extending from the tubular body. The downhole expandable liner hanger may further comprise a first slip ring, wherein the first slip ring is disposed around the tubular body of the expansion element between the first spike and the second spike, wherein the first slip ring is configured to expand radially as the expansion element expands.

20 Claims, 5 Drawing Sheets

(56) References Cited

U.S. PATENT DOCUMENTS

| | | | | |
|---|---|---|---|---|
| 2015/0068733 | A1 | 3/2015 | Dilber et al. | |
| 2016/0053591 | A1 | 2/2016 | Hallundbæk et al. | |
| 2016/0090801 | A1 | 3/2016 | Hazelip et al. | |
| 2016/0145957 | A1* | 5/2016 | Davies | E21B 33/1216 166/382 |
| 2016/0326830 | A1* | 11/2016 | Hallundbk | E21B 33/1208 |
| 2017/0226815 | A1* | 8/2017 | Zakharia | E21B 43/108 |

* cited by examiner

EXPANDABLE HANGER WITH ANCHOR FEATURE

BACKGROUND

During wellbore operations, it is typical to "hang" a liner onto a casing such that the liner supports an extended string of tubular below it. As used herein, "tubing string" refers to a series of connected pipe sections, casing sections, joints, screens, blanks, cross-over tools, downhole tools and the like, inserted into a wellbore, whether used for drilling, work-over, production, injection, completion, or other processes. A tubing string may be run in and out of the casing, and similarly, tubing string can be run in an uncased wellbore or section of wellbore. Further, in many cases a tool may be run on a wireline or coiled tubing instead of a tubing string, as those of skill in the art will recognize.

Expandable liner hangers may generally be used to secure the liner within a previously set casing or liner string. Expandable liner hangers may be "set" by expanding the liner hanger radially outward into gripping and sealing contact with the casing or liner string. For example, expandable liner hangers may be expanded by use of hydraulic pressure to drive an expanding cone, wedge, or "pig," through the liner hanger. Other methods may be used, such as mechanical swaging, explosive expansion, memory metal expansion, swellable material expansion, electromagnetic force-driven expansion, etc.

The expansion process may typically be performed by means of a setting tool used to convey the liner hanger into the wellbore. The setting tool may be interconnected between a work string (e.g., a tubular string made up of drill pipe or other segmented or continuous tubular elements) and the liner hanger. The setting tool may expand the liner hanger into anchoring and sealing engagement with the casing.

As can be appreciated, the expanded liner hanger may support the substantial weight of the attached tubing string below. For deep and extra-deep wells, subsea wells, etc., the tubing string places substantial axial load on the hanging mechanism engaging the liner hanger to the casing. Typically, axial load capacity may be dependent upon applied internal and/or external pressure. These design features may be sensitive to wellbore variables and casing properties.

BRIEF DESCRIPTION OF THE DRAWINGS

For a detailed description of the preferred embodiments of the invention, reference will now be made to the accompanying drawings in which.

DETAILED DESCRIPTION

The present disclosure relates generally to equipment utilized and operations performed in conjunction with a subterranean well and, more particularly, to an improved liner hanger system. More specifically, an improved downhole expandable liner hanger with an anchor feature. The improved downhole expandable liner hanger may comprise a rubber element bonded to a tubular body that may then be expanded in an open-ended environment where only the strength of the rubber element may be available to withstand certain forces for a successful installation. An improvement in the downhole expandable liner hanger may involve incorporating a ring around the expandable tubular body to increase the axial load capacity.

Illustrative embodiments of the present disclosure are described in detail below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but it would nevertheless be a routine undertaking for those of ordinary skill in the art having the benefit of the present disclosure.

In order to facilitate a better understanding of the present disclosure, the following examples of certain embodiments are given. In no way should the following examples be read to limit, or define, the scope of the disclosure. Embodiments may be applicable to injection wells as well as production wells, including hydrocarbon wells. Devices and methods in accordance with certain embodiments may be used in one or more of wireline, measurement-while-drilling (MWD) and logging-while-drilling (LWD) operations. Certain embodiments according to the present disclosure may provide for a single trip liner setting and drilling assembly.

Figure 1:
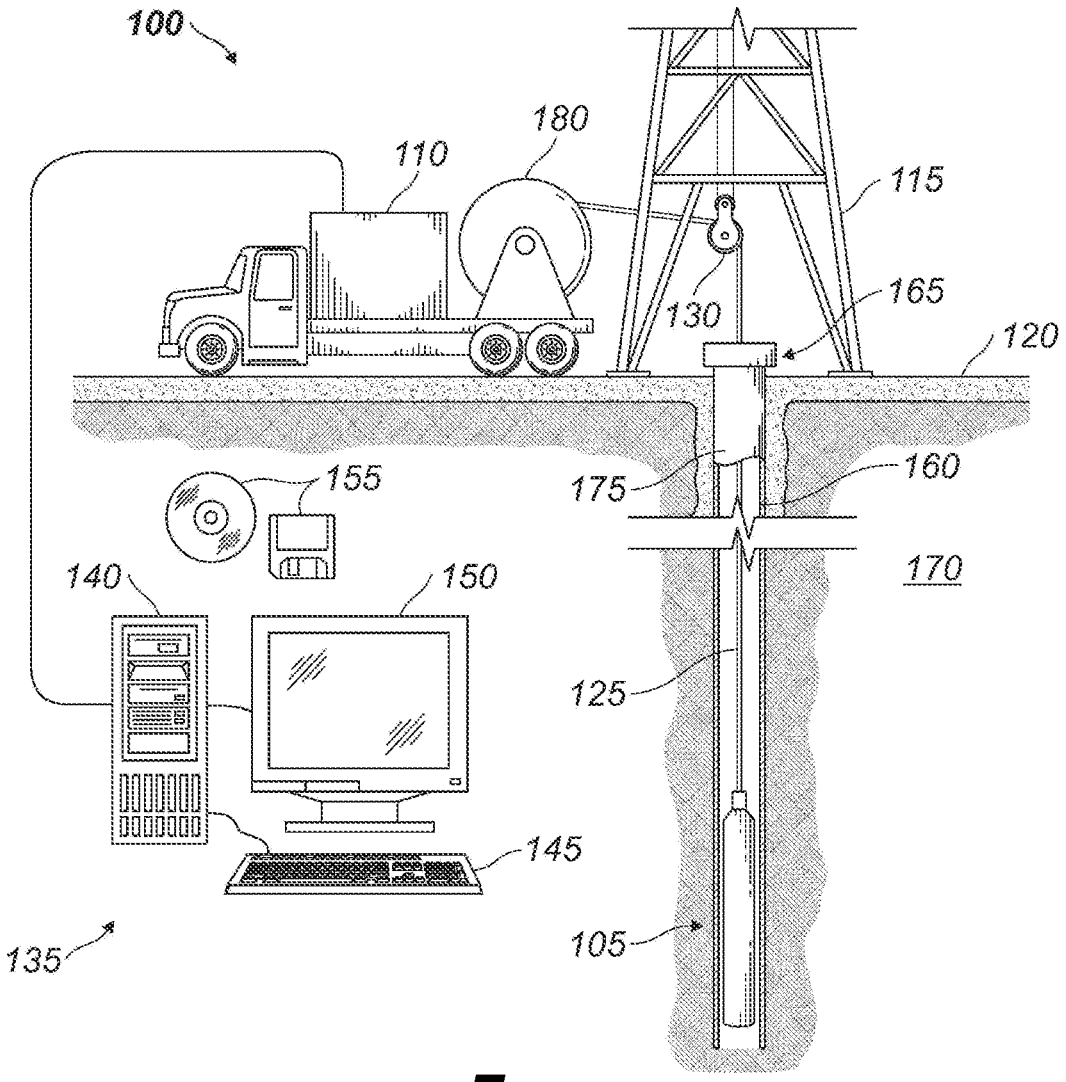
FIG. 1 illustrates an example of a well system.

FIG. 1 illustrates a cross-sectional view of a well system 100. As illustrated, well system 100 may comprise an expandable liner hanger 105 attached to a vehicle 110. In examples, it should be noted that expandable liner hanger 105 may not be attached to a vehicle 110 but may be attached to any other suitable object. Expandable liner hanger 105 may be supported by a rig 115 at a surface 120. Expandable liner hanger 105 may be tethered to vehicle 110 through a conveyance 125. Conveyance 125 may be disposed around one or more sheave wheels 130 located on vehicle 110. During operations, the one or more sheave wheels 130 may rotate to lower and/or raise conveyance 125 downhole. As expandable liner hanger 105 is coupled to conveyance 125, expandable liner hanger 105 may be displaced accordingly with conveyance 125. Conveyance 125 may include any suitable means for providing mechanical conveyance for expandable liner hanger 105 including, but not limited to, wireline, slickline, coiled tubing, pipe, drill pipe, drill string, tubular string, downhole tractor, and/or the like. In some embodiments, conveyance 125 may provide mechanical suspension, as well as electrical connectivity, for expandable liner hanger 105. In examples, expandable liner hanger 105 may be disposed about a downhole tool (not illustrated). Without limitations, the downhole tool may be any suitable downhole tool configured to perform a well completions operation and/or to obtain measurements while downhole. Information, such as measurements, from the downhole tool may be gathered and/or processed by an information handling system 135.

Systems and methods of the present disclosure may be implemented, at least in part, with information handling system 135. Information handling system 135 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, information handling system 135 may comprise a processing unit 140, a network storage device, or any other suitable device and may vary in size, shape, performance, functionality, and price. Information handling system 135 may include random access memory (RAM), one or more processing resources such as a central processing unit (CPU) or hardware or software control logic, ROM, and/or other types of nonvolatile memory. Additional components of the information handling system 135 may include one or more disk drives, one or more network ports for communication with external devices as well as various input and output (I/O) devices, such as an input device 145 (e.g., keyboard, mouse, etc.) and a video display 150. Information handling system 135 may also include one or more buses operable to transmit communications between the various hardware components.

Alternatively, systems and methods of the present disclosure may be implemented, at least in part, with non-transitory computer-readable media 155. Non-transitory computer-readable media 155 may include any instrumentality or aggregation of instrumentalities that may retain data and/or instructions for a period of time. Non-transitory computer-readable media 155 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

As illustrated, expandable liner hanger 105 may be disposed in a wellbore 160 by way of conveyance 125. Wellbore 160 may extend from a wellhead 165 into a subterranean formation 170 from surface 120. Wellbore 160 may be cased and/or uncased. In examples, wellbore 160 may comprise a metallic material, such as a tubular string 175. By way of example, tubular string 175 may be a casing, liner, tubing, or other elongated tubular disposed in wellbore 160. As illustrated, wellbore 160 may extend through subterranean formation 170. Wellbore 160 may generally extend vertically into the subterranean formation 170. However, wellbore 160 may extend at an angle through subterranean formation 170, such as horizontal and slanted wellbores. For example, although wellbore 160 is illustrated as a vertical or low inclination angle well, high inclination angle or horizontal placement of the well and equipment may be possible. It should further be noted that while wellbore 160 is generally depicted as a land-based operation, those skilled in the art may recognize that the principles described herein are equally applicable to subsea operations that employ floating or sea-based platforms and rigs, without departing from the scope of the disclosure.

In examples, rig 115 includes a load cell (not shown) which may determine the amount of pull on conveyance 125 at surface 120 of wellbore 160. While not shown, a safety valve may control the hydraulic pressure that drives a drum 180 on vehicle 110 which may reel up and/or release conveyance 125 which may move expandable liner hanger 105 up and/or down wellbore 160. The safety valve may be adjusted to a pressure such that drum 180 may only impart a small amount of tension to conveyance 125 over and above the tension necessary to retrieve conveyance 125 and/or expandable liner hanger 105 from wellbore 160. The safety valve may typically be set a few hundred pounds above the amount of desired safe pull on conveyance 125 such that once that limit is exceeded, further pull on conveyance 125 may be prevented.

Figure 2:
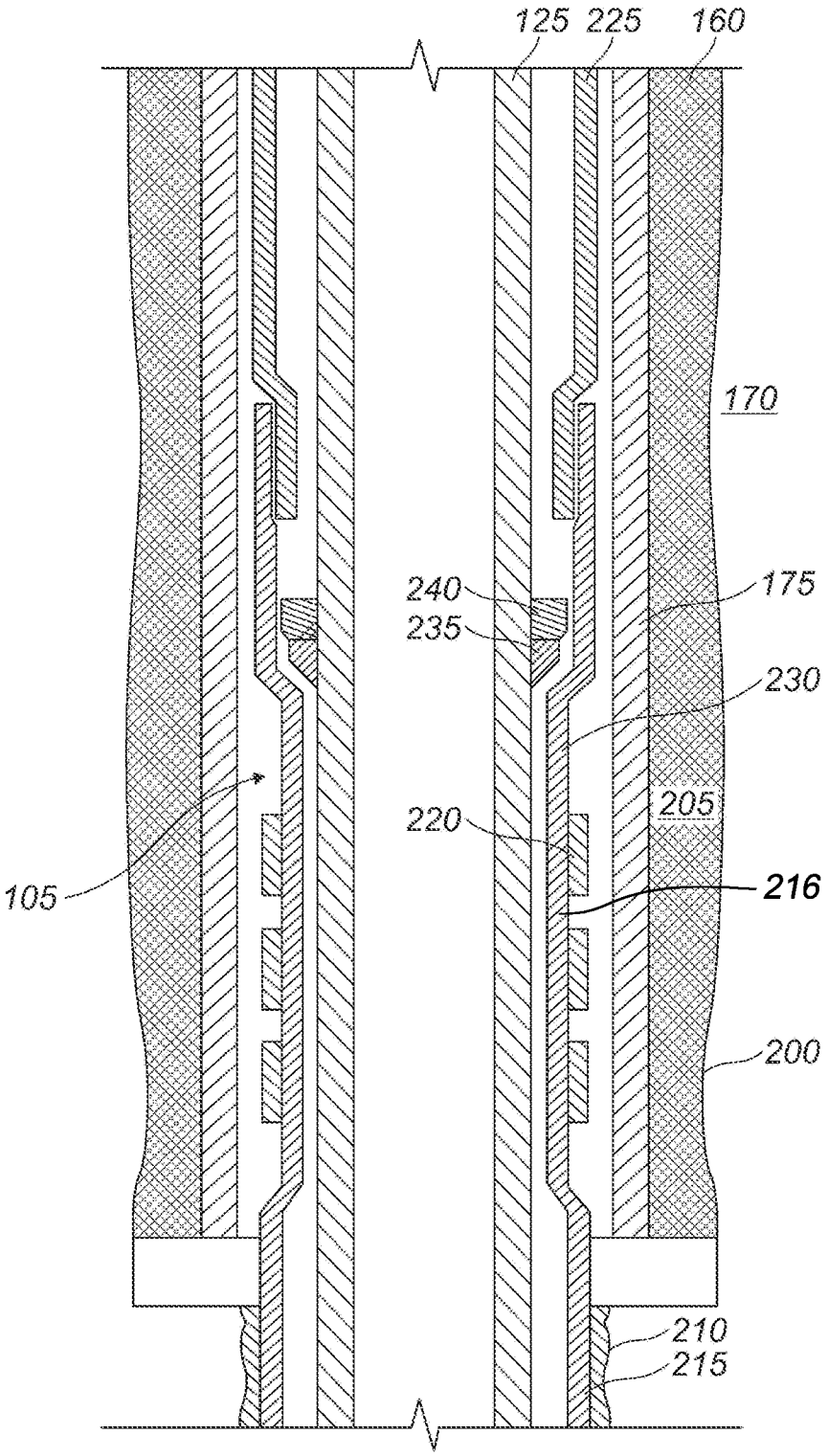
FIG. 2 illustrates an example of an expandable liner hanger.

FIG. 2 illustrates an example of expandable liner hanger 105. As shown in FIG. 2, wellbore 160 may be drilled through subterranean formation 170. A tubular string 175 may then be placed in an upper portion 200 of wellbore 160 and held in place by cement 205, which is injected between tubular string 175 and upper portion 200 of wellbore 160. Below tubular string 175, a lower portion 210 of wellbore 160 may be drilled through tubular string 175. Lower portion 210 may have a smaller diameter than upper portion 200. A length of a liner 215 of expandable liner hanger 105 is shown positioned within lower portion 210. Liner 215 may be used to line or case lower portion 210 and/or to drill lower portion 210. If desired, cement 205 may be placed between liner 215 and lower portion 210 of wellbore 160. Liner 215 may be installed in wellbore 160 by means of conveyance 125. In examples, both tubular string 175 and expandable liner hanger 105 may be elastically and/or plastically strained.

Attached to the upper end of, or formed as an integral part of, liner 215 is expandable liner hanger 105, which may include a number of annular seals 220 comprising a rubber element, polymer host, elastomer, and/or combinations thereof. While three seals 220 on each side are depicted for illustrative purposes, any number of seals 220 may be used. It may be desirable that the outer diameter of liner 215 be as large as possible while being able to lower liner 215 through tubular string 175. It may also be desirable that the outer diameter of a polished bore receptacle 225 and expandable liner hanger 105 be about the same as the diameter of liner 215. In the run-in condition, the outer diameter of expandable liner hanger 105 is defined by the outer diameter of annular seals 220. In the run-in condition, an expansion element 230 of expandable liner hanger 105 may have an outer diameter reduced by about the thickness of annular seals 220 so that the outer diameter of annular seals 220 is about the same as the outer diameter of liner 215 and polished bore receptacle 225. Expansion element 230 may comprise a tubular body 216 on which the annular seals 220 may be disposed. The majority of the designs used for annular seals 220 may utilize a contained system to prevent the rubber element from extruding or moving out of the seal gland. Examples of these seal designs include O-rings, x-seals, t-seals, and packers. Generally, liner hangers may be unique because they require conveyance before expansion, which results in an open-ended containment system during in situ expansion.

Applied mechanical stress, fluid stress, temperature, and fluid compatibility all work to reduce the physical properties of rubber elements within annular seals 220. When applied to a solid expandable liner hanger, the rubber element must withstand several different scenarios that are unique to the application. During run-in-hole (RIH), the outbound surface of the rubber element may be exposed to drilling fluids and the inner surface must remain securely bonded to the tubular. During expansion, the same rubber element may be able to withstand up to a 10% diametrical expansion. Further, the rubber element may support a high compressive load when interacting with the casing, and in the case of the standard 12-inch element, a resultant shear force may be generated acting to effectively extrude the rubber element. Further, increased temperature may degrade mechanical properties needed to withstand all of these scenarios. Thus, once conveyed, the rubber element may withstand extrusion forces at high pressure and temperatures. While improvements may be made to the manner in which the rubber elements are loaded, a separate improvement in expandable liner hanger 105 may help improve performance in terms of both sealing and anchoring capacity.

FIG. 2 further illustrates first and second expansion cones 235 and 240, which may be carried on conveyance 125 just above reduced diameter expansion element 230 of expandable liner hanger 105. Fluid pressure applied between conveyance 125 and expandable liner hanger 105 may be used to drive cones 235, 240 downward through expandable liner hanger 105 to expand expansion element 230 to an outer diameter at which annular seals 220 are forced into sealing and supporting contact with tubular string 175.

Figure 3:
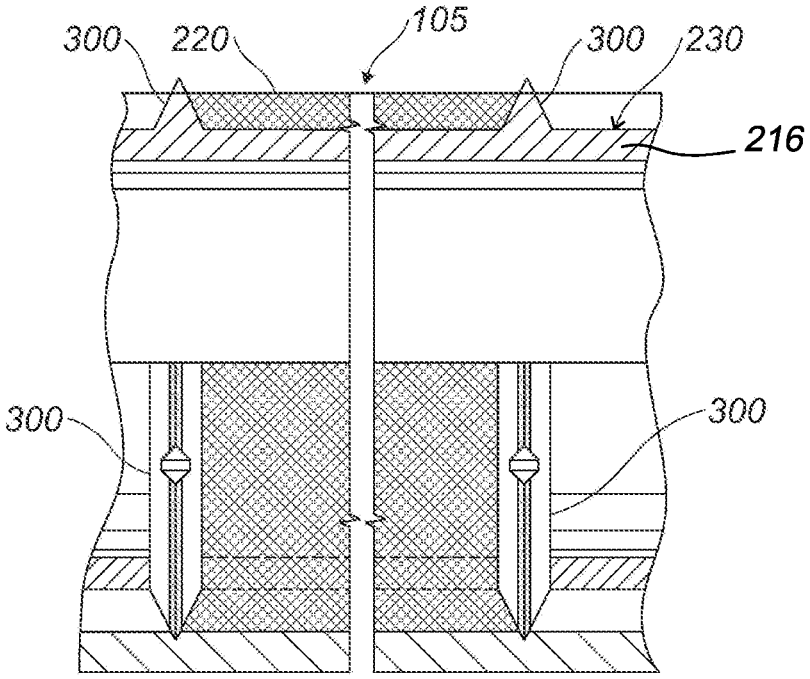
FIG. 3 illustrates a portion of an expansion element of a liner hanger with spikes.

FIG. 3 illustrates a portion of expansion element 230 of expandable liner hanger 105. FIG. 3 further illustrates annular seals 220 disposed between containment spikes 300. Annular seals 220 and containment spikes 300 may be disposed on tubular body 216 of the expansion element 230. Spikes 300 may be metal spikes. The metal spikes may be made of any suitable steel grade, aluminum, any other ductile material, or a combination thereof. Spikes 300 may be any suitable size, height, and/or shape. In certain implementations, each spike 300 may be a circular ring that extends along an outer perimeter of expandable liner hanger 105 at a desired axial location. However, the present disclosure is not limited to this particular configuration of spikes 300. For instance, spikes 300 may extend along an axial direction of expandable liner hanger 105. Moreover, in certain implementations, different spikes 300 may have different surface geometries without departing from the scope of the present disclosure. Specifically, a first spike may extend along an outer perimeter of expandable liner hanger 105 at a first axial position along expandable liner hanger 105, and a second spike may extend along an outer perimeter of expandable liner hanger 105 at a second axial position along expandable liner hanger 105. In certain examples, spikes 300 may be trapezoidal in shape.

Figure 4A:
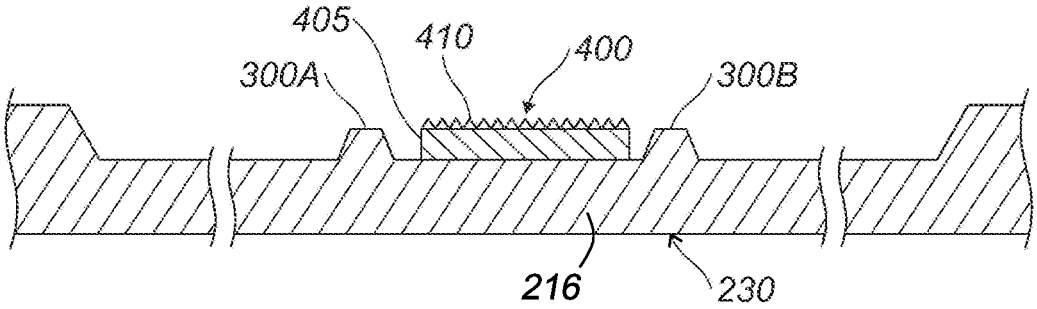
FIG. 4A illustrates an example of a slip ring disposed on an expansion element.
Figure 4B:
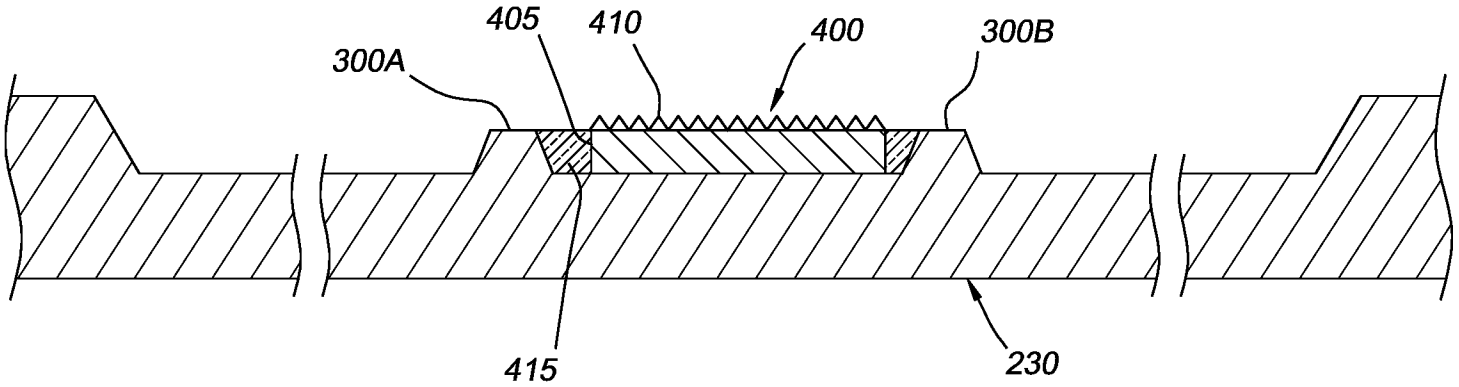
FIG. 4B illustrates another example of a slip ring disposed on an expansion element.

FIG. 4A illustrates an example of expansion element 230 of expandable liner hanger 105 with a slip ring 400 disposed on tubular body 216. Slip ring 400 may be utilized to increase the axial load capacity of expandable liner hanger 105. Expandable liner hanger 105 may comprise a plurality of slip rings 400. Slip ring 400 may be any suitable size, height, and/or shape. Without limitation, a suitable shape may include, but is not limited to, cross-sectional shapes that are circular, elliptical, triangular, rectangular, square, hexagonal, and/or combinations thereof. In examples, slip ring 400 may have a circular cross section with an inner and outer diameter forming a ring. Slip ring 400 may be a solid ring, slotted, segmented, and/or combinations thereof. Without limitation, slip ring 400 may comprise any suitable material such as metals, nonmetals, polymers, ceramics, and/or any combination thereof. As illustrated, slip ring 400 may be disposed around expansion element 230 in between a first spike 300A and a second spike 300B, wherein first spike 300A and second spike 300B may be trapezoidal-shaped protrusions extending outward from expansion element 230. As illustrated on FIG. 4B, slip ring 400 may be encased in an encasement 415. For example, the encasement 415 may be positioned between the slip ring 400 and the spikes, e.g., first spike 300A and second spike 300B. The encasement 415 may be constructed from any suitable material, including, but not limited to, elastomeric materials.

Referring against to FIG. 4A, as expansion element 230 is configured to expand radially when acted upon, slip ring 400 may expand in accordance with expansion element 230. In examples, slip ring 400 may be elastically and/or plastically strained. As expansion element 230 and slip ring 400 expand, slip ring 400 may be contained laterally between expansion element 230 and tubular string 175 (i.e., referring to FIG. 1). Additionally, the placement of slip ring 400 between first spike 300A and second spike 300B may limit a vertical range of motion for slip ring 400. Slip ring 400 may be self-locking, wherein slip ring 400 is prevented from moving axially between first spike 300A and second spike 300B. Alternatively, slip ring 400 may be free-floating, wherein slip ring 400 is capable of translating between first spike 300A and second spike 300B and rotating around expansion element 230.

As illustrated, slip ring 400 may comprise a body 405 and a plurality of teeth 410. Body 405 may be attached to expandable liner hanger 105 so as to be disposed around expansion element 230 through the use of any suitable mechanisms, including, but not limited to, the use of suitable fasteners, shrink fit, threading, adhesives, welding, and/or combinations thereof. Without limitation, suitable fasteners may include nuts and bolts, washers, screws, pins, sockets, rods and studs, hinges and/or any combination thereof. Referring again to FIG. 4B, encasement 415 can secure the slip ring 400 to the expansion element 230. With additional reference to FIG. 4A, the interior side of body 405 may be coated so as to reduce the friction between slip ring 400 and expansion element 230. Without limitations, the interior side of body 405 may be coated with MoS2, any suitable solid film lubricant, QPQ, and/or combinations thereof. The plurality of teeth 410 may be disposed on an external side of the outer diameter of body 405. The plurality of teeth 410 may be disposed in any suitable fashion, such as, but not limited to, uniformly or randomly along body 405. The plurality of teeth 410 may be configured to engage with an interior side of tubular string 175 and increase surface contact area between slip ring 400 and tubular string 175 to increase friction between the two. In other examples, the plurality of teeth 410 may be disposed on an internal side of the inner diameter of body 405. In more examples, the plurality of teeth 410 may be disposed both on the external side of the outer diameter of body 405 and on the internal side of the inner diameter of body 405. The plurality of teeth 410 may be any suitable size, height, and/or shape. In examples, each one of the plurality of teeth 410 may have the same dimensions. In other examples, each one of the plurality of teeth 410 may have different dimensions. The plurality of teeth 410 may be disposed at any suitable angle and/or direction in relation to tubular string 175. In examples, the plurality of teeth 410 may be disposed at about a thirty-degree angle sloping upwards in relation to tubular string 175. In other examples, the plurality of teeth 410 may be disposed at about a thirty-degree angle sloping downwards in relation to tubular string 175. Without limitations, the plurality of teeth 410 may be surface hardened by flame hardening, laser transformation hardening, e-beam hardening, induction hardening, and/or the like.

As expandable liner hanger 105 expands, the plurality of teeth 410 may engage with tubular string 175. In examples, a portion of expansion element 230 may be tapered. Application of an axial force in one direction may cause slip between expandable liner hanger 105 and tubular string 175. The slip may cause slip ring 400 to be pushed further outward radially as slip ring 400 encounters the portion of expansion element 230 that is tapered. This may cause further engagement of the plurality of teeth 410 with tubular string 175. As a result, expandable liner hanger 105 may have an increase in axial load capacity. In examples, expandable liner hanger 105 may comprise a first slip ring 400 with the plurality of teeth 410 facing upwards and a second slip ring 400 with the plurality of teeth 410 facing downwards. This may increase the resistance to axial movement in both directions while within tubular string 175.

Figure 5:
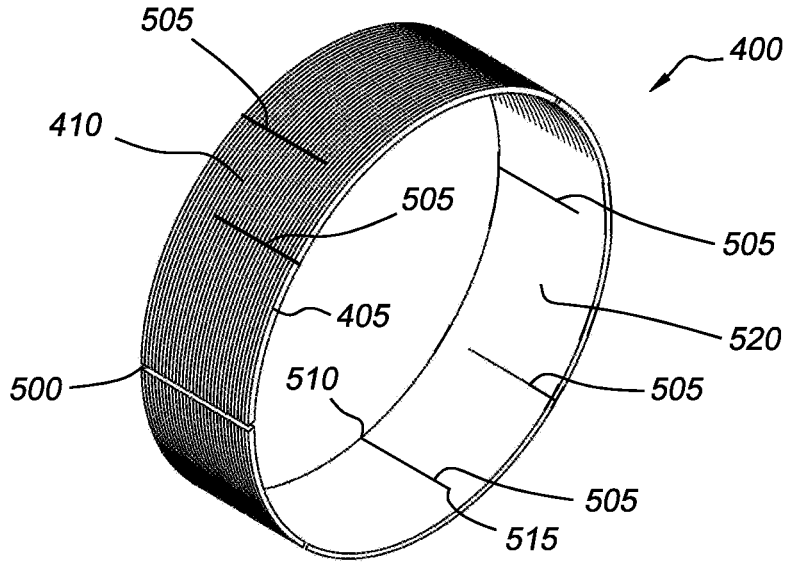
FIG. 5 illustrates an example of a slip ring.

FIG. 5 illustrates an example of slip ring 400. As illustrated, the slip ring 400 includes a body 405 and a plurality of teeth 410 that face outwardly. While FIG. 5 illustrates plurality of teeth 410 on the outer diameter of the body 405, embodiments may further include inner teeth (not shown) positioned on the inner diameter 520 of the body 405. As illustrated, the inner diameter 520 may generally be a cylindrical surface. However, the inner diameter 520 may be otherwise configured as desired for a particular application. In the illustrated embodiment, the slip ring includes a slot 500 cut through the body 405. As illustrated, the slot 500 cuts through the body 405 from end to edge such that the slip ring 400 can be considered to be a "C-ring." In addition to the slot 500 that cuts through the body 405, body 405 may also include one or more additional slots 505 that only extend partially through the body 405 with a first end 510 at an edge of the body 405 and a second end 515 at an inner portion of the body 405.

Figure 6A:
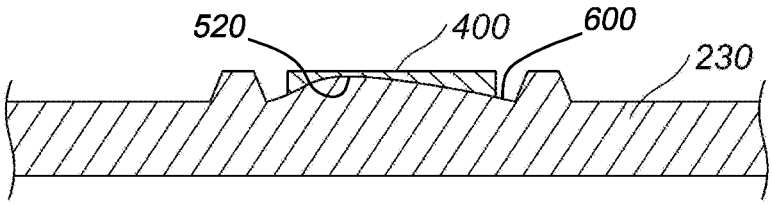
FIG. 6A illustrates an example of a slip ring disposed on an expansion element.
Figure 6B:
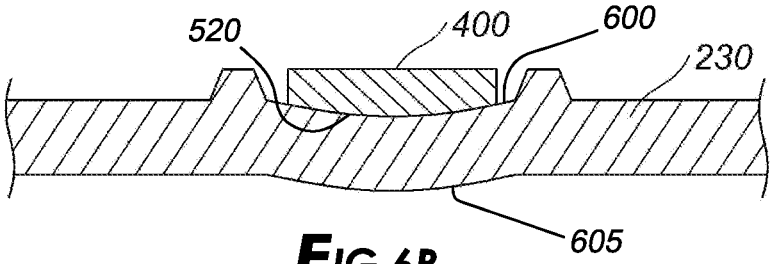
FIG. 6B illustrates an example of a slip ring disposed on an expansion element.
Figure 6C:
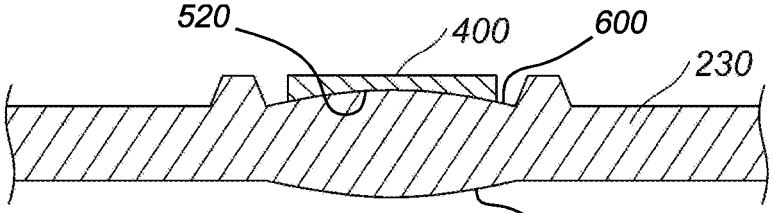
FIG. 6C illustrates an example of a slip ring disposed on an expansion element.

FIGS. 6A-6C illustrate varying examples of slip ring 400 implemented on expansion element 230. FIG. 6A illustrates an embodiment of expansion element 230 comprising a compound curvature for the exterior surface 600 corresponding to the slip ring 400 in that the exterior surface 600 comprises a curve made up of two or more circular arcs. As illustrated, the inner diameter 520 of the slip ring 400 may have a corresponding compound curvature. FIG. 6B illustrates an embodiment of expansion element 230 comprising an exterior surface 600 corresponding to the slip ring 400 that is concave while the opposing inner surface 605 is convex. As illustrated, the inner diameter 600 may have a curvature that corresponds to the exterior surface 600 that is concave. FIG. 6C illustrates an embodiment of expansion element 230 comprising an exterior surface 600 corresponding to the slip ring 400 that is convex while the opposing inner surface 605 is also convex. As illustrated, the inner diameter 600 may have a curvature that corresponds to the exterior surface 600 that is convex. With regard to these examples, slip ring 400 may be disposed flush with the exterior side of expansion element 230. In alternate examples, there may be a tolerance between slip ring 400 and expansion element 230 that provides a gap.

During operations, once wellbore 160 (i.e., referring to FIG. 1) is drilled in a subterranean operation, it may be cased using methods and systems known to those of ordinary skill in the art. For instance, tubular string 175 (i.e., referring to FIG. 1) may be lowered into wellbore 160 and cemented in place. Liner 215 (i.e., referring to FIG. 2) coupled to expandable liner hanger 105 (i.e., referring to FIG. 1) in accordance with an implementation of the present disclosure may then be lowered downhole through tubular string 175. Once liner 215 reaches a desired position downhole, the expansion element 230 of expandable liner hanger 105 may expand. Once expandable liner hanger 105 expands, seals 220 (i.e., referring to FIG. 2) may form a seal with the inner surface of tubular string 175. This seal may couple liner 215 to tubular string 175. Concerning the present disclosure, the implementation of slip ring 400 may increase the axial load resistance and/or capacity of expandable liner hanger 105. Further, slip ring 400 may not damage tubular string 175 and may operate in response to an axial load.

Accordingly, this disclosure describes systems and methods that may relate to subterranean operations. The systems and methods may further be characterized by one or more of the following statements:

Statement 1. A downhole expandable liner hanger positionable in a subterranean wellbore may comprise an expansion element. The expansion element may comprise a tubular body. The expansion element may comprise one or more annular seals bonded to the tubular body. The expansion element may comprise a first spike extending from the tubular body. The expansion element may comprise a second spike extending from the tubular body. The downhole expandable liner hanger may further comprise a first slip ring, wherein the first slip ring is disposed around the tubular body of the expansion element between the first spike and the second spike, wherein the first slip ring is configured to expand radially as the expansion element expands.

Statement 2. The downhole expandable liner hanger of statement 1, wherein the first spike and the second spike are trapezoidal.

Statement 3. The downhole expandable liner hanger of statement 1 or 2, wherein a portion of the tubular body is tapered.

Statement 4. The downhole expandable liner hanger of any preceding statement, wherein an exterior surface of the expansion element comprises a compound curvature.

Statement 5. The downhole expandable liner hanger of any one of statements 1 to 3, wherein an exterior surface of the expansion element is concave and an interior side of the expansion element is convex.

Statement 6. The downhole expandable liner hanger of any one of statements 1 to 3, wherein an exterior surface of the expansion element is convex and an interior surface of the expansion element is convex.

Statement 7. The downhole expandable liner hanger of any preceding statement, wherein the first slip ring comprises a body and a plurality of teeth, wherein the plurality of teeth are disposed on an external side of the outer diameter of the body.

Statement 8. The downhole expandable liner hanger of statement 7, wherein the plurality of teeth are disposed on an interior side of the body.

Statement 9. The downhole expandable liner hanger of statement 7, wherein the plurality of teeth are disposed uniformly along the external side of the outer diameter of the body, wherein each one of the plurality of teeth have the same dimensions.

Statement 10. The downhole expandable liner hanger of statement 7, wherein the plurality of teeth are disposed at about a thirty degree angle sloping upwards or downwards in relation to a tubular string.

Statement 11. The downhole expandable liner hanger of statement 7, wherein the plurality of teeth are surface hardened by flame hardening, laser transformation hardening, e-beam hardening, induction hardening, or combinations thereof.

Statement 12. The downhole expandable liner hanger of statement 7, further comprising a second slip ring, wherein the plurality of teeth of the second slip ring are disposed at an opposite direction in comparison to the plurality of teeth of the first slip ring in relation to a tubular string.

Statement 13. The downhole expandable liner hanger of any preceding statement, wherein an interior side of the body is coated with a material selected from a group consisting of MoS2, a solid film lubricant, QPQ, or combinations thereof.

Statement 14. The downhole expandable liner hanger of any preceding statement, wherein the slip ring is self-locking, wherein the slip ring is constrained from moving axially between the first spike and the second spike.

Statement 15. The downhole expandable liner hanger of any preceding statement, wherein the slip ring is free-floating, wherein the slip ring is configured to translate between the first spike and the second spike and rotate around the expansion element.

Statement 16. The downhole expandable liner hanger of any preceding statement, wherein the slip ring comprises slot extending through a body of the slip ring such that the slip ring is a C-ring.

Statement 17. The downhole expandable liner hanger of any preceding statement, further comprising an encasement positioned between the slip ring and the first spike and between the slip ring and the second spike.

Statement 18. The downhole expandable liner hanger of claim 17, wherein the encasement comprises an elastomer.

Statement 19. A tubular string positionable in a subterranean wellbore may comprise a liner. The tubular string may further comprise a downhole expandable liner hanger at an upper end of the liner. The downhole expandable liner may comprise an expansion element. The expansion element may comprise a tubular body. The expansion element may comprise one or more annular seals bonded to the tubular body. The expansion element may comprise a first spike extending from the tubular body. The expansion element may comprise a second spike extending from the tubular body. The downhole expandable liner hanger may further comprise a first slip ring, wherein the first slip ring is disposed around the tubular body of the expansion element between the first spike and the second spike, wherein the first slip ring is configured to expand radially as the expansion element expands.

Statement 20. The tubular string of statement 19, further comprising an encasement positioned between the slip ring and the first spike and between the slip ring and the second spike, wherein the encasement comprises an elastomer.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole expandable liner hanger positionable in a subterranean wellbore, comprising:

an expansion element, wherein the expansion element comprises:

a tubular body;

one or more annular seals bonded to the tubular body, the one or more annular seals configured to seal against a tubular string exterior to the tubular body;

a first spike extending from the tubular body; and a second spike extending from the tubular body; and a slip ring disposed around the tubular body of the expansion element between the first spike and the second spike, wherein the slip ring is configured to expand radially as the expansion element expands, wherein the slip ring occupies a majority of an axial distance extending from the first spike to the second spike, wherein the tubular body comprises at least one curved surface that curves along the axial distance between the first and second spikes.

2. The downhole expandable liner hanger of claim 1, wherein the first spike and the second spike are trapezoidal.

3. The downhole expandable liner hanger of claim 1, wherein a portion of the tubular body is tapered.

4. A downhole expandable liner hanger positionable in a subterranean wellbore, comprising:

an expansion element, wherein the expansion element comprises:

a tubular body;

one or more annular seals bonded to the tubular body;

a first spike extending from the tubular body; and a second spike extending from the tubular body; and a slip ring disposed around the tubular body of the expansion element between the first spike and the second spike, wherein the slip ring is configured to expand radially as the expansion element expands, wherein an exterior surface of the expansion element comprises a compound curvature.

5. A downhole expandable liner hanger positionable in a subterranean wellbore, comprising:

an expansion element, wherein the expansion element comprises:

a tubular body;

one or more annular seals bonded to the tubular body, the one or more annular seals configured to seal against a tubular string exterior to the tubular body;

a first spike extending from the tubular body; and a second spike extending from the tubular body; and a slip ring disposed around the tubular body of the expansion element between the first spike and the second spike, wherein the slip ring is configured to expand radially as the expansion element expands, wherein an exterior surface of the expansion element is concave and an interior side of the expansion element is convex.

6. The downhole expandable liner hanger of claim 1, wherein an exterior surface of the expansion element is convex and an interior surface of the expansion element is convex.

7. The downhole expandable liner hanger of claim 1, wherein the slip ring comprises a body and a plurality of teeth.

8. The downhole expandable liner hanger of claim 7, wherein the plurality of teeth are disposed on an external side of the body.

9. The downhole expandable liner hanger of claim 7, wherein the plurality of teeth are disposed uniformly along the external side of the outer diameter of the body, wherein each one of the plurality of teeth have the same dimensions.

10. The downhole expandable liner hanger of claim 7, wherein the plurality of teeth are disposed at a thirty degree angle sloping upwards or downwards in relation to the tubular string.

11. The downhole expandable liner hanger of claim 7, wherein the plurality of teeth are surface hardened by flame hardening, laser transformation hardening, e-beam hardening, induction hardening, or combinations thereof.

12. The downhole expandable liner hanger of claim 1, wherein the slip ring is constrained from moving axially between the first spike and the second spike.

13. The downhole expandable liner hanger of claim 1, wherein the slip ring is coated with a material selected from a group consisting of MoS2, a solid film lubricant, QPQ, or combinations thereof.

14. The downhole expandable liner hanger of claim 1, wherein the at least one curved surface comprises a first curved surface that is opposite to a second curved surface, wherein each curved surface curves along the axial distance between the first and second spikes.

15. A downhole expandable liner hanger positionable in a subterranean wellbore, comprising:

an expansion element, wherein the expansion element comprises:

a tubular body;

one or more annular seals bonded to the tubular body;

a first spike extending from the tubular body; and a second spike extending from the tubular body; and a slip ring disposed around the tubular body of the expansion element between the first spike and the second spike, wherein the slip ring is configured to expand radially as the expansion element expands, wherein the slip ring is free-floating, wherein the slip ring is configured to translate between the first spike and the second spike and rotate around the expansion element.

16. The downhole expandable liner hanger of claim 1, wherein the slip ring comprises a slot extending through a body of the slip ring.

17. The downhole expandable liner hanger of claim 16, wherein the slip ring is a C-ring.

18. The downhole expandable liner hanger of claim 17, wherein the slip ring is in contact with a first elastomer and a second elastomer, wherein the first elastomer is in contact with the first spike, wherein the second elastomer is in contact with the second spike.

19. A tubular string positionable in a subterranean wellbore, comprising:

a liner, a downhole expandable liner hanger at an upper end of the liner, wherein the downhole expandable liner hanger comprises:

a tubular expansion element having a reduced diameter with respect to the liner;

one or more annular seals bonded to the tubular expansion element, the one or more annular seals configured to seal against a tubular exterior to the tubular string;

a first spike extending from the tubular expansion element; and a second spike extending from the tubular expansion element; and a slip ring, wherein the slip ring is disposed around a tubular body of the expansion element between the first spike and the second spike, wherein the slip ring is configured to expand radially as the expansion element expands, wherein the slip ring occupies a majority of an axial distance extending from the first spike to the second spike, wherein the tubular body of the expansion element comprises at least one curved surface that curves along the axial distance between the first and second spikes.

20. The tubular string of claim 19, wherein the slip ring is in contact with a first elastomer and a second elastomer, wherein the first elastomer is in contact with the first spike, wherein the second elastomer is in contact with the second spike.

* * * * *